United States Patent [19]

Segil

[11] 4,133,160

[45] Jan. 9, 1979

[54] LIGHT REFLECTING AND SHIELDING MODULES FOR SUSPENDED CEILINGS AND ACCESSORIES THEREFOR

[76] Inventor: Arthur W. Segil, 3611 Commercial, Northbrook, Ill. 60062

[21] Appl. No.: 834,437

[22] Filed: Sep. 19, 1977

[51] Int. Cl.[2] ..... E04H 12/18

[52] U.S. Cl. ..... 52/645; 52/664; 52/669

[58] Field of Search ..... 52/645, 473, 663, 664, 52/666, 667, 28, 669; 362/325, 342, 290, 292; 229/15

[56] References Cited

U.S. PATENT DOCUMENTS

| | | | |
|---|---|---|---|
| 2,680,501 | 6/1954 | Cunningham | 229/15 R |
| 3,511,404 | 5/1970 | Pearson | 229/28 R |
| 3,969,870 | 7/1976 | Deaton | 52/645 |
| 4,042,991 | 8/1977 | Macy et al. | 52/645 |

*Primary Examiner*—James L. Ridgill, Jr.
*Attorney, Agent, or Firm*—Richard C. Lindberg

[57] ABSTRACT

A light reflecting and shielding module for a suspended ceiling or the like is disclosed. The module is enabled to be shipped or stored in flattened condition and is comprised of a pair of planar rail members with at least one baffle member hingedly connected thereto and extending transversely thereof. Upon erection of the rail members to parallel spaced relationship, the centroid of the mass of the baffle is spaced from the axis of hinge means connecting same to the rail members, so that upon erection of the rail members the mass centroid of the baffle causes same to hang pendently from the spaced and parallel rail members.

8 Claims, 9 Drawing Figures

LIGHT REFLECTING AND SHIELDING MODULES FOR SUSPENDED CEILINGS AND ACCESSORIES THEREFOR

BACKGROUND OF THE INVENTION

1. Field of the Invention

The structure disclosed herein is particularly applicable to suspended ceiling installations where lighting sources and heating, ventilating and air conditioning apparatus are concealed above the suspended ceiling. The module herein disclosed is effective for diffusing light from a source thereabove.

2. Summary of the Invention

The structure according to the invention enables installation from a suspended ceiling framework to proceed in an efficient manner, and enables shipping and storage of the modules with a minimum amount of space required.

THE DRAWINGS

Figure 1:
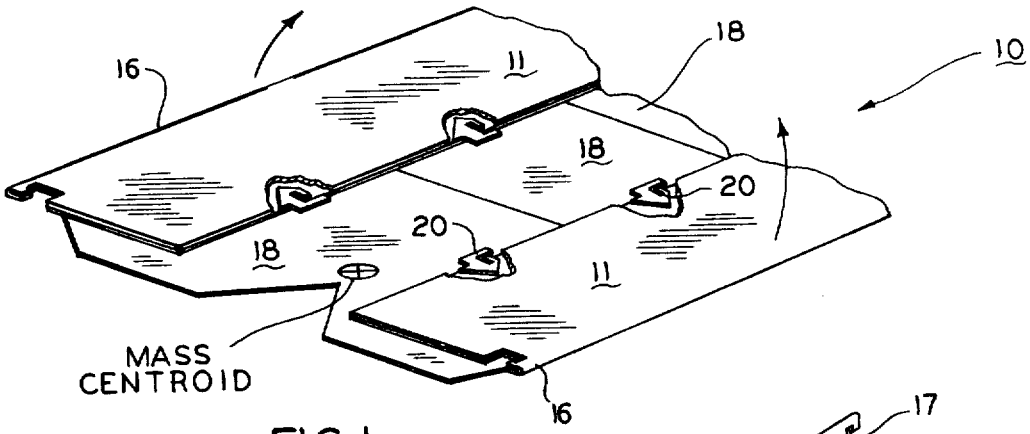
FIG. 1 is an isometric view of a portion of a light reflecting and shielding module according to the present invention, showing the same in flattened condition for shipping or storage.

The light reflecting baffle module according to the invention is denoted by the reference numeral 10 and comprises spaced planar rail members 11 and 12, each of such members having double sides 13 and 14 in contact with each other, and joined along the under sides thereof along a fold line 16. Each end of the rail members 11 and 12 are provided with notches 17 for support on suspended ceiling framework, not shown.

Figure 4:
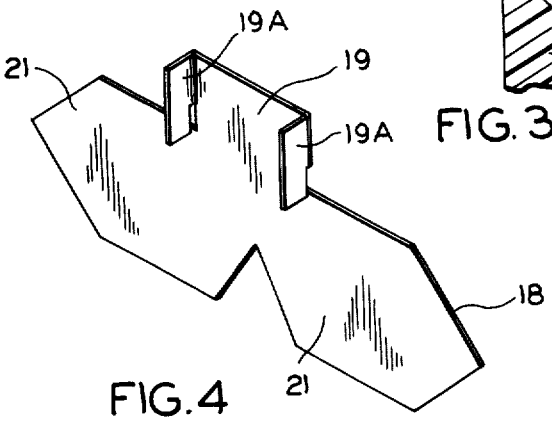
FIG. 4 is an isometric view of a typical baffle member adapted to be used with the module of FIGS. 1 and 2.

A series of baffle members 18 are connected by hinge means 20 at spaced intervals along the length of the rail members 11, 12 and extend transversely thereof. The baffle members 18 are generally in the shape of an inverted T with a vertical leg 19 and arms 21 extending from the leg 19 and below the lower edges of the rail members 11,12. Each of the baffle members 18 has the sides of the vertical leg 19 reinforced by a double thickness of the material of baffle 18 as at 19A, see particularly FIG. 4.

The structure thus far described enables both the rail members 11, 12 and baffle members 18 to be folded into a flat arrangement as seen in FIG. 1, such being accomplished by the compliance of the hinge means 20.

Figure 2:
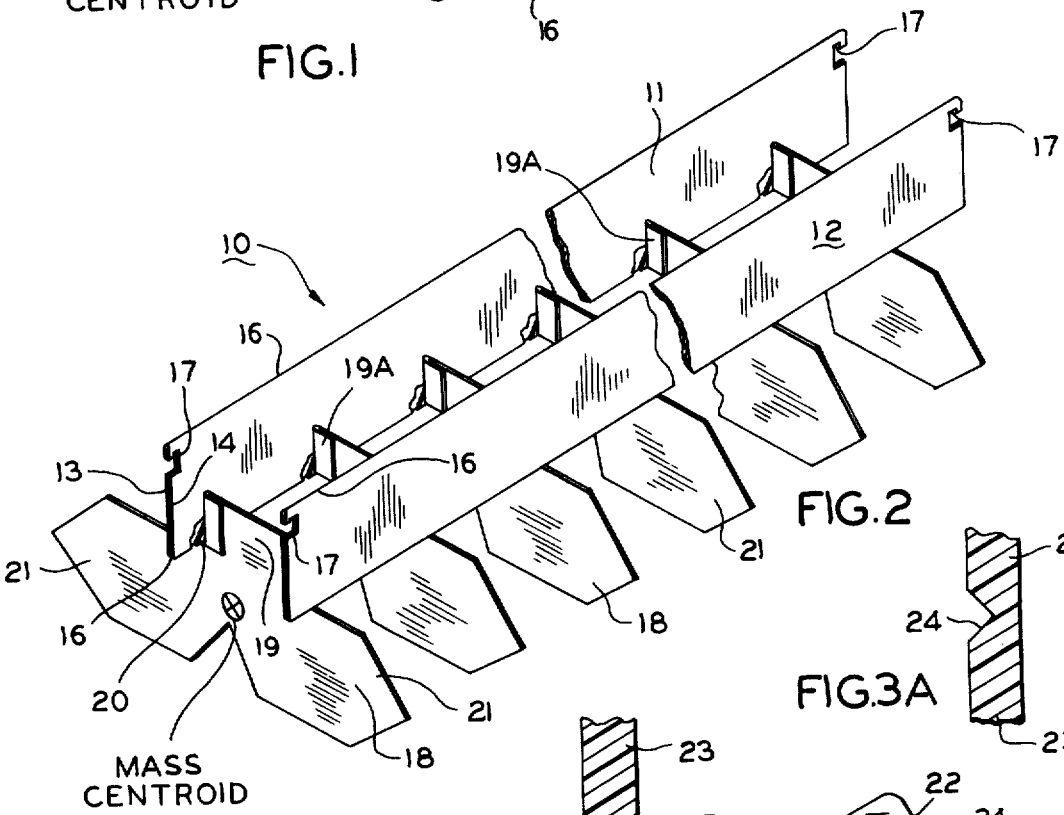
FIG. 2 is an isometric view showing the module of FIG. 1 in erected position.

The structure 10 can be manipulated to the position seen in FIG. 2 by moving the paired rail members 11,12 toward each other as indicated by the arrows seen in FIG. 1 until rail members 11, 12 are in erect vertical position. The baffle members 18 have their mass centroids lying below an axis passing through the compliant hinge means 20, and the mass centroid of each baffle 18 causes each to move into a vertical plane extending transversely to the planes of rail members 11, 12. Upon the erection of the module 10 it can be placed on the suspended ceiling framework.

Figure 3A:
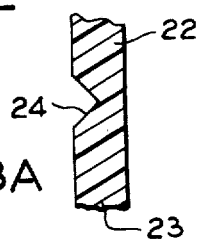
FIG. 3A is a section taken along the line 3A—3A of FIG. 3 looking in the direction of the arrows.
Figure 3B:
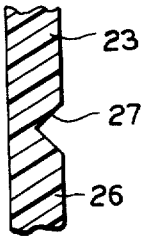
FIG. 3B is a section taken along the line 3B—3B of FIG. 3 looking in the direction of the arrows.
Figure 3:
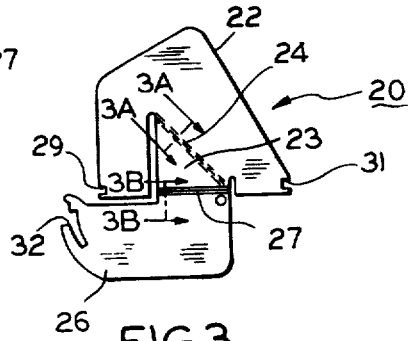
FIG. 3 is a plan view of a hinge for connecting baffle members of the module of FIG. 2 to rail members supporting the same.

The hinge means 20 comprises a hinge leaf 22 joined to a second hinge leaf 23 along an indented diagonal score line 24, see FIGS. 3 and 3A. A third hinge leaf 26 is joined to second hinge leaf 23 along an indented score line 27.

Hinge means 20 is preferably made of a tough plastomer such as nylon or the like, and the hinge leaves 22, 23 and 26 are enabled to be folded with respect to each along the score lines 24 and 27. In folding from the flat connection of hinge means 20 to the folded position, which occurs upon erection of module 10 as seen in FIG. 2, leaf 23 is folded along diagonal score line 24 into face-to-face contact with leaf 22, and leaf 26 is folded along its score line 27 into a plane at right angles to the plane of hinge leaf 22.

Figure 5:
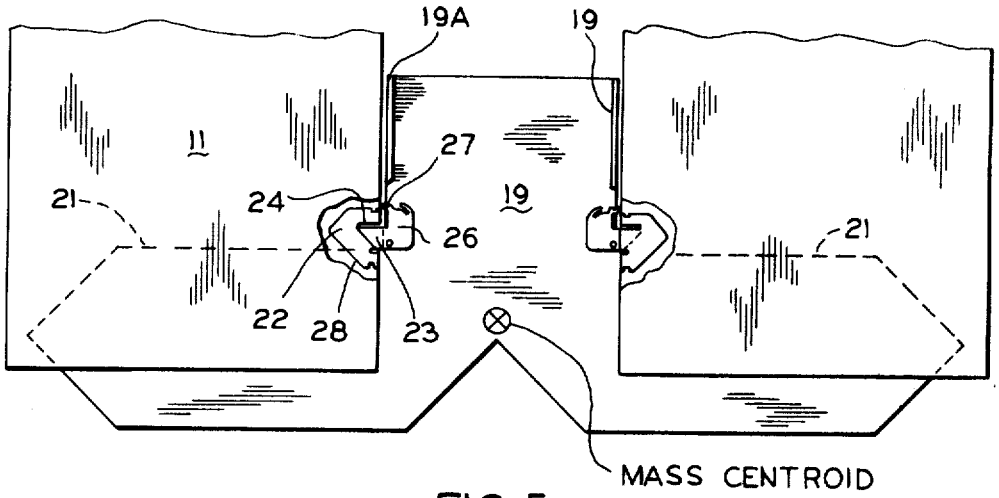
FIG. 5 is a plan view of a portion of the module of FIGS. 1 and 2 showing details of a hinge structure connecting the rail members to a baffle member.
Figure 6:
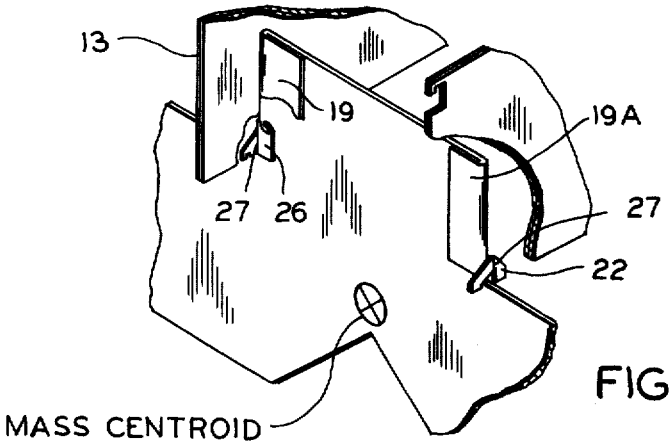
FIG. 6 is an isometric view showing details of the hinge connection between a baffle member and a rail member.
Figure 7:
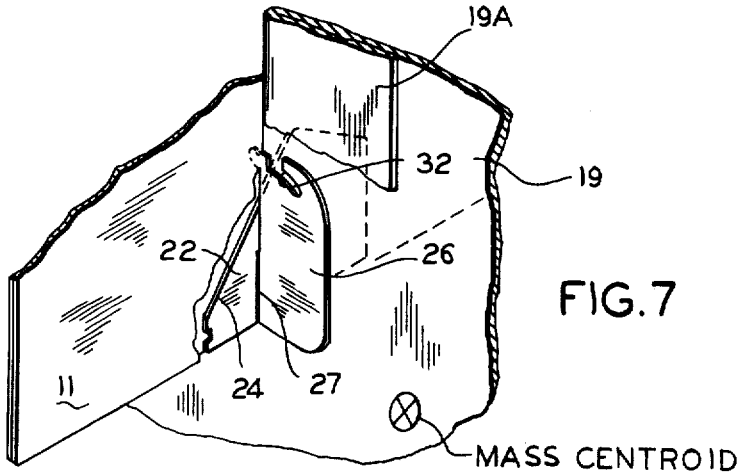
FIG. 7 is an isometric view showing further details of such connection.

As seen in FIGS. 5 & 7 hinge leaf 22 is joined by a suitable adhesive to the rail member 11 on its side 14, hinge leaf 26 being joined by such adhesive to leg 19 of baffle 18 just above the point where arms 21 of baffle 18 extend therefrom.

In some cases hinge leaf 22 is inserted against side 13 of the rail member 12, it lying in a cutout portion 28 in side 14.

Hinge leaf 22 is provided with notches 29 and 31 which engage the lower edges of sides 13 and 14 to assist in locating leaf 22, and leaf 26 has a notch 32 engaging with sides of vertical leg 19.

I claim:

1. A light reflecting and shielding module for a suspended ceiling or the like, said module being enabled to be shipped in a flattened condition and subsequently erected to an operative position to be supported from a suspended ceiling frame work, said module comprising:
   a. a pair of spaced rail members arranged in coplanar relationship and movable by said framework after erection thereof;
   b. at least one baffle member hingedly connected to said rail members and extending transversely thereof; and foldable against said rail members when the latter are in coplanar relationship;
   c. yieldable hinge means connecting said baffle member to each of said rail members;
   d. the centroid of the mass of said baffle member being below the lower extremities of said rail members;
   e. said hinge means yielding upon erection of said rail members to operative position so that the centroid of the mass of said baffle causes the same to move to pendent position transversely of said rail members.

2. A module according to claim 1 wherein said hinge means is formed from a plastomer enabling said baffle member to move slowly to erected position upon erection of said rail members.

3. A module according to claim 1 wherein said hinge means is provided with limbs engaging said baffle and said rails.

4. A module according to claim 3 wherein said hinge means includes a diagonally extending hinge line enabling the baffle to move to pendent position upon erection of said rail members.

5. A module according to claim 1 wherein said baffle member has a portion extending between said rail members upon erection of the latter.

6. A module according to claim 5 wherein the portion of said baffle member extending between said erected rail members substantially spans the distance therebetween.

7. A module according to claim 1 wherein said baffle member is generally in the form of an inverted T with the centroid of the mass of the baffle lying below the vertical leg of said T.

8. A module according to claim 7 wherein the leg of said T extends between said rail members when erected to span substantially the distance between the latter.

* * * * *